US007959528B1

(12) United States Patent
Wilkes et al.

(10) Patent No.: US 7,959,528 B1
(45) Date of Patent: Jun. 14, 2011

(54) BASEBALL BATTING STRENGTH TRAINING AID

(75) Inventors: Floyd Wilkes, Jupiter, FL (US); David Carson, Stuart, FL (US)

(73) Assignee: Hondo Sports Training, LLC, Stuart, FL (US)

( * ) Notice: Subject to any disclaimer, the term of this patent is extended or adjusted under 35 U.S.C. 154(b) by 0 days.

(21) Appl. No.: 12/424,762

(22) Filed: Apr. 16, 2009

(51) Int. Cl.
*A63B 69/00* (2006.01)

(52) U.S. Cl. ..... 473/453; 473/451; 482/84; 482/87

(58) Field of Classification Search ..... 473/441–445, 473/451–455; 482/83, 84, 86, 87, 89, 90
See application file for complete search history.

(56) References Cited

U.S. PATENT DOCUMENTS

| | | | | |
|---|---|---|---|---|
| 3,944,225 | A | 3/1976 | Greaney | |
| 4,093,217 | A * | 6/1978 | Piccini | 473/451 |
| 4,123,053 | A * | 10/1978 | Piccini | 473/451 |
| 4,185,821 | A * | 1/1980 | Piccini | 473/451 |
| 4,883,271 | A * | 11/1989 | French | 273/454 |
| 4,989,865 | A * | 2/1991 | Plevier | 473/453 |
| 5,269,512 | A | 12/1993 | Crowson et al. | |
| 5,280,905 | A * | 1/1994 | Micco | 473/444 |
| 5,281,191 | A * | 1/1994 | DeSousa | 482/83 |
| 5,503,391 | A * | 4/1996 | Stelly | 473/451 |
| 5,554,088 | A * | 9/1996 | Zlojutro | 482/83 |
| 5,738,599 | A * | 4/1998 | Malwitz | 473/423 |
| 5,980,397 | A | 11/1999 | Hart et al. | |
| 6,514,163 | B2 | 2/2003 | Burns | |
| 6,716,121 | B1 * | 4/2004 | Brown | 473/451 |
| 6,726,605 | B2 * | 4/2004 | Chen | 482/87 |
| 6,976,926 | B2 | 12/2005 | LaPointe | |
| 7,128,692 | B2 * | 10/2006 | Black | 482/8 |
| 7,300,365 | B2 * | 11/2007 | Taylor | 473/451 |
| 7,479,094 | B1 * | 1/2009 | Alexander | 482/83 |
| 2003/0069095 | A1 | 4/2003 | Turos | |
| 2003/0216228 | A1 * | 11/2003 | Rast | 482/84 |
| 2003/0220177 | A1 * | 11/2003 | Orlando | 482/148 |
| 2004/0048696 | A1 | 3/2004 | Ciesar et al. | |
| 2004/0097347 | A1 * | 5/2004 | Ghim | 482/84 |
| 2006/0223657 | A1 * | 10/2006 | Flanigan | 473/423 |
| 2006/0240917 | A1 | 10/2006 | Campbell et al. | |
| 2006/0270494 | A1 | 11/2006 | Presley | |
| 2007/0087911 | A1 * | 4/2007 | Ghim | 482/84 |
| 2009/0176632 | A1 * | 7/2009 | Wiber | 482/84 |
| 2009/0291780 | A1 | 11/2009 | Gutierrez | |

FOREIGN PATENT DOCUMENTS

| | | |
|---|---|---|
| WO | 8501219 | 3/1985 |

* cited by examiner

*Primary Examiner* — Mark S Graham
(74) *Attorney, Agent, or Firm* — McHale & Slavin, P.A.

(57) ABSTRACT

A baseball batting strength-training aid includes a vertically oriented resilient cylindrical body defining a central core. A mount is affixed to a rear of the resilient body for attaching the training aid to an external support. A sensor pod is received within the central core of the resilient body, which includes at least one sensor thereto for sensing the striking of a bat against the resilient cylindrical body.

19 Claims, 10 Drawing Sheets

BASEBALL BATTING STRENGTH TRAINING AID

BACKGROUND OF THE INVENTION

1. Field of the Invention

The present invention relates to sports training aids in general and more particularly to a baseball strength training aid.

2. Discussion of the Related Art

When a new player begins to learn how to play a ball game such as baseball, one of the fundamental requirements is to learn how to hit and catch the ball. Teaching a ball player the proper technique for swinging a bat to obtain optimal power can be a difficult task. It often requires years of practice and training with an experienced batting coach to perfect the batter's swing. Proper swing technique encompasses proper hand placement and body movement, optimal bat acceleration, and ample power to hit the ball and is of the utmost importance in playing such sports as baseball.

In batting practice, the trainer typically tosses the ball to the trainee and issues verbal instructions such as "swing" or "keep your eye on the ball". To a new student, the proper way to execute these instructions is not always immediately clear and a long, iterative process ensues. Other utilized methods of presenting a ball to a trainee include hanging a ball by a string, placing a ball on a support, or ejecting a ball from a machine. Some trainees master these instructions quickly but in the vast majority of cases the learning process continues for an extended period before the trainee can hit the ball with a semblance of consistency.

Repeatedly pitching a ball to a trainee merely adds inconsistency to the process since the trainer loses control of the ball when it leaves his hand and is often unable to repeatedly duplicate the same pitch. The trainee has an extremely brief time to react to the pitched ball, frequently missing the ball entirely. The missed ball must then be retrieved and the trainer and trainee must then resume their positions before the lesson can be repeated. This method of training, while effective for initially teaching ball hitting, is highly inefficient in the use of time and the speed at which the trainee learns. This method also fails to effectively concentrate on teaching and learning proper batting technique. Further, as the trainee becomes more experienced, the changes necessary to optimize the batter's technique become more subtle and nuanced and are not readily identified and corrected by swinging at pitched balls.

In addition to learning to coordinate the placement of the bat during the swing to hit the ball as it crosses the plate, the advanced trainee must also learn proper form and technique to deliver optimum power to the pitched ball at the point of contact. For example, one of the factors related to being able to deliver power to the ball includes proper arm placement to prevent inadvertent extension of the leading arm during the initial-to-mid portions of a batter's swing at a baseball. Improper extension of the leading arm inhibits the twisting force of the body to not fully transmit to the bat because of the long moment-arm created by the extension, and thus failing to deliver the desired power to the ball when hit.

Hitting power is also a function of the degree of flexure of the triceps muscle. Optimal hitting power requires the triceps muscle of the leading arm to provide maximum flexing power and speed at the time the bat is beginning to pass in front of the batter's body. Thus, a great deal of the power generated in swinging a bat is based upon the timing and flexure of the batter's leading arm coordinated with a twisting of the upper torso in the direction of the swing.

Thus, what is desired is batting training aid to provide rapid feedback to a batter that indicates when the batter is utilizing proper technique for swinging a bat in order to achieve maximum bat speed and optimum power at impact with a ball.

SUMMARY OF THE INVENTION

The present invention is directed to a baseball batting strength training aid that satisfies the need for rapid and accurate feedback on the positioning and power of a bat swing. The baseball batting strength-training aid includes a vertically oriented resilient cylindrical body defining a central core. A mount is affixed to a rear of the resilient body for attaching the training aid to an external support. A sensor pod is received within the central core of the resilient body, which includes at least one sensor thereto for sensing the striking of a bat against the resilient cylindrical body.

Another aspect of the present invention is a baseball batting strength training aid including a vertically oriented resilient cylindrical body that defines a central core. A mount affixed to a rear of the resilient body for attaching the training aid to a vertical external support. The mount defines a vertically oriented elongate recess for receiving a portion of the vertical external support therein to maintain the training aid in a vertical orientation. A sensor pod is received within the central core of the resilient body and has a plurality of accelerometers mounted thereto for sensing the striking of a bat against the resilient cylindrical body. An electronic display is communicatively coupled to the plurality of accelerometers and configured to integrate outputs of the accelerometers. The integrated accelerometer output is displayed to provide an indication of the striking power of a bat strike upon the resilient cylindrical body.

These and other features, aspects, and advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the accompanying drawings in which.

Like reference numerals refer to like parts throughout the several views of the drawings.

DETAILED DESCRIPTION OF THE PREFERRED EMBODIMENT

Figure 1:
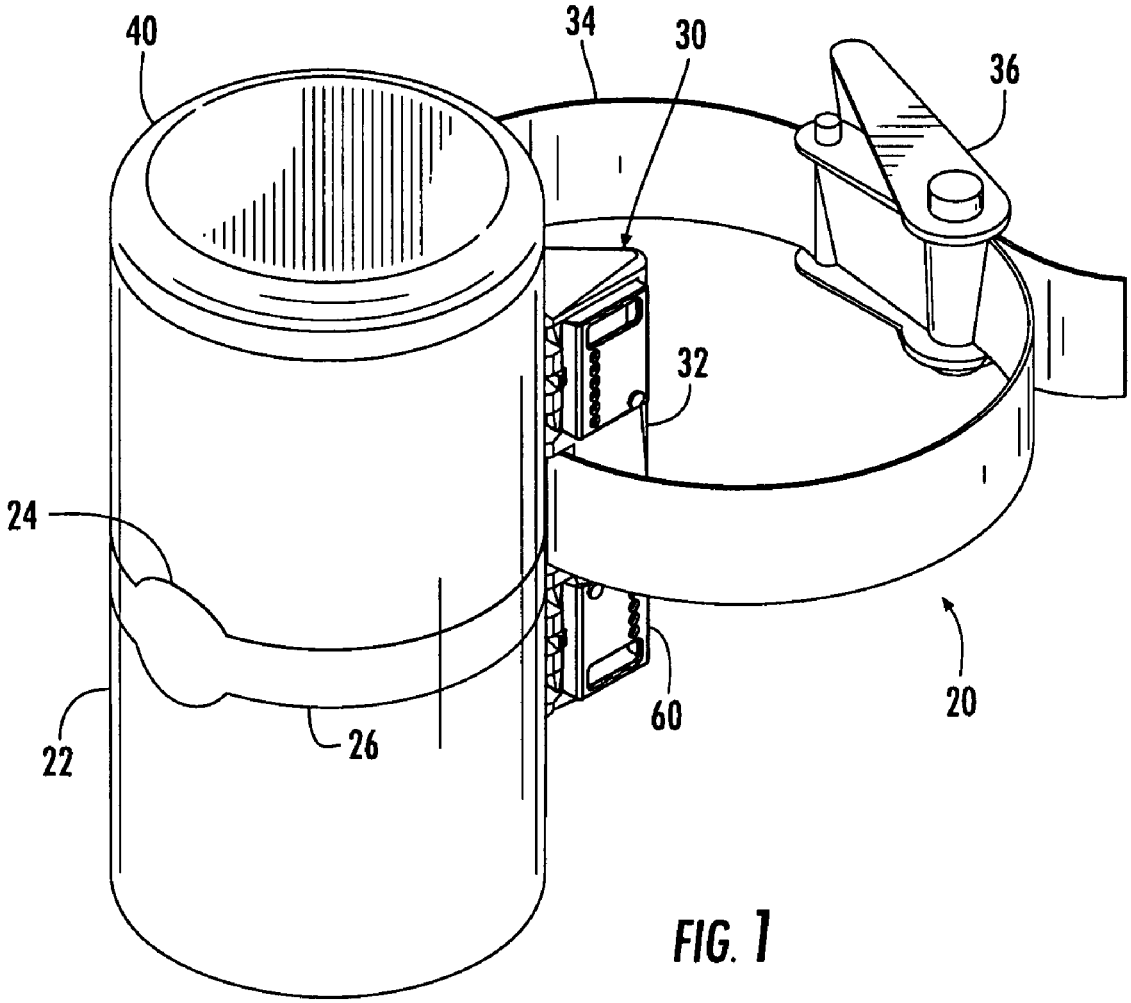
FIG. 1 is a perspective view of a batting training aid embodying the present invention.
Figure 2:
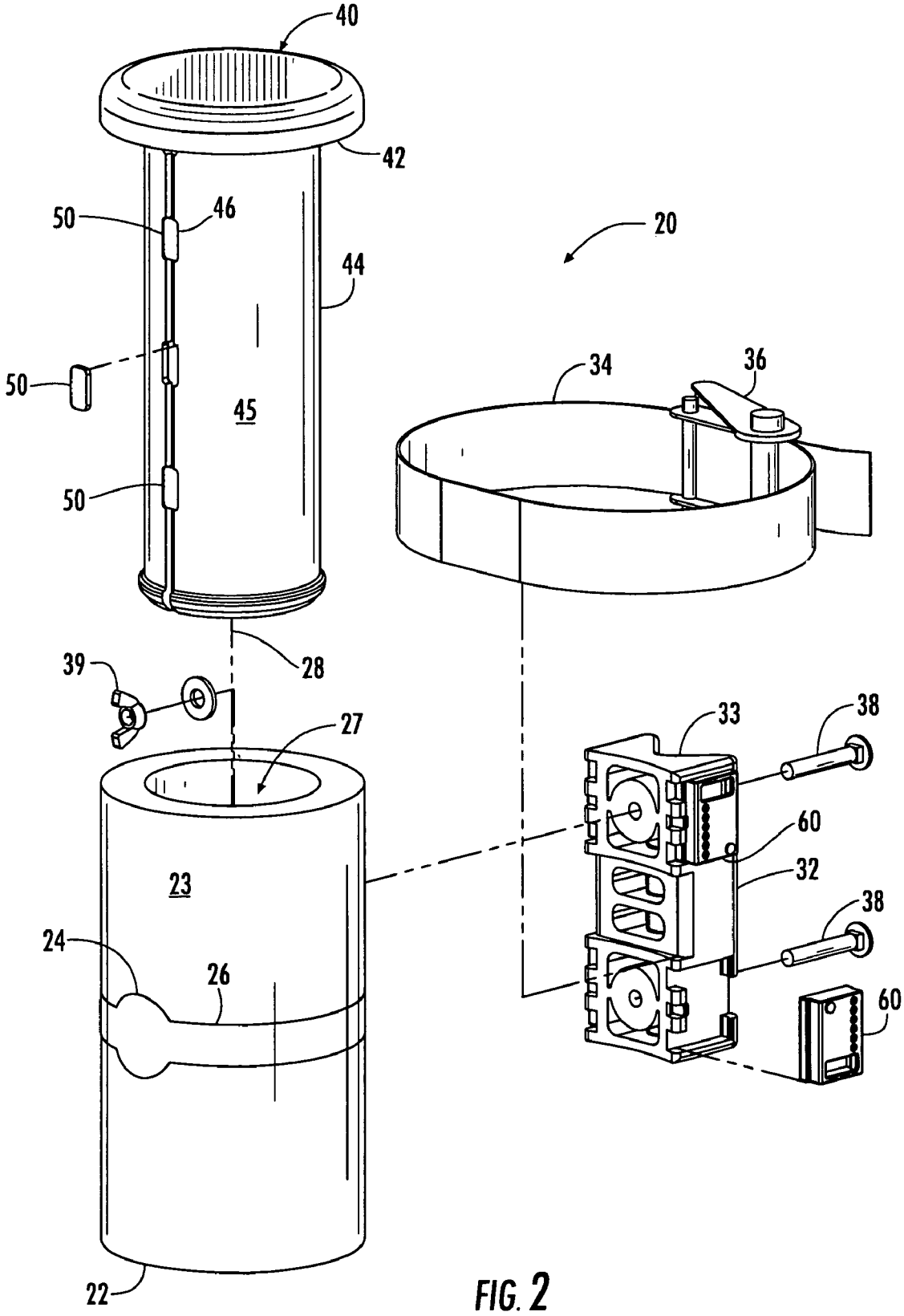
FIG. 2 is an exploded perspective view of the batting training aid of FIG. 1.
Figure 3:
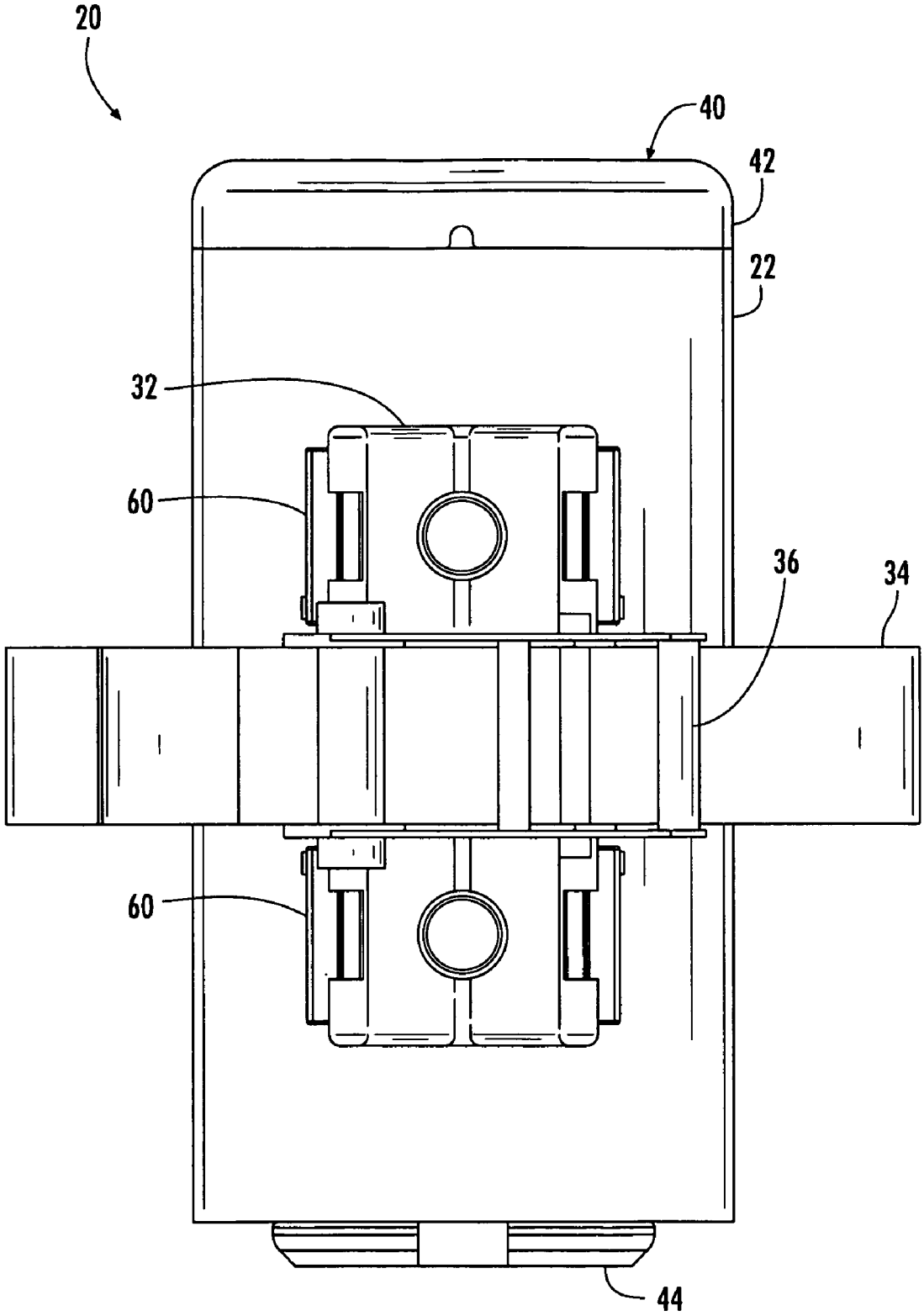
FIG. 3 is a rear view of the batting aid of FIG. 1 illustrating the batting training aid mounting provisions.
Figure 4:
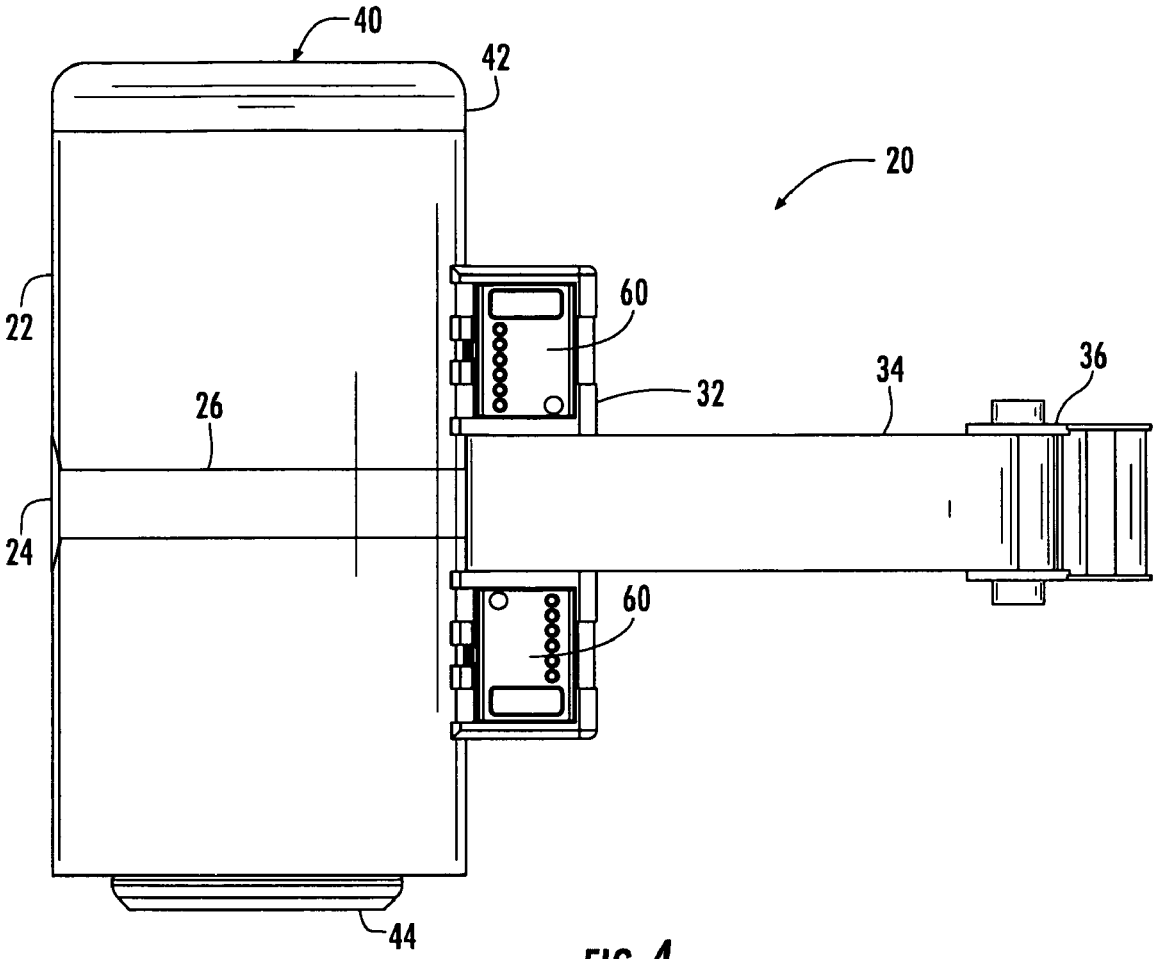
FIG. 4 is a side elevation view of the batting training aid.
Figure 5:
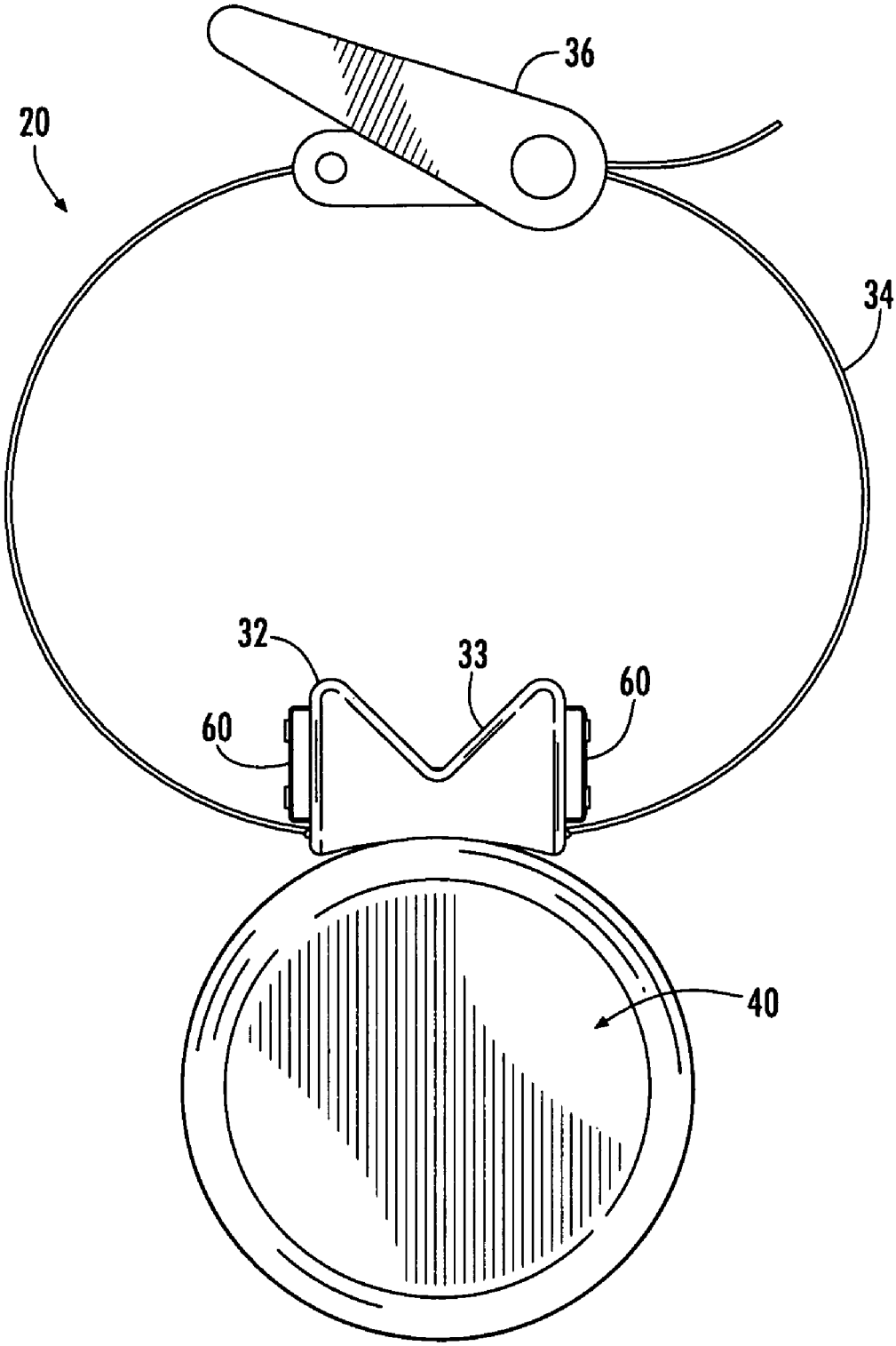
FIG. 5 is a top plan view of the batting training aid.

For purposes of description herein, the terms "upper", "lower", "left", "rear", "right", "front", "vertical", "horizontal", and derivatives thereof shall relate to the invention as oriented in FIGS. 1 and 2. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1-5 show a baseball batting strength-training aid 20, which is one of the preferred embodiments of the present invention and illustrates its various components. Training aid 20 includes a vertically oriented resilient cylindrical body 22 typically fabricated from a dense foam, rubber, and the like, capable of withstanding repeated strikes from a bat without incurring damage or deformation. A visible target 24 is painted or embossed on an outer surface 23 of cylindrical body 23. Target 24 is positioned at a vertical midpoint in front of cylindrical body 22 and can further include a visible band 26 circumferentially extending around cylindrical body 22 to enhance the batters aim. Cylindrical body 22 also defines a central core 27 having an axis 28.

A sensor pod 40 is constructed of a substantially rigid material and comprises a cylindrical pod body 44 sized to be closely received in central core 27. A cap 42 at the top of sensor pod 40 extends radially outward from pod body 44 and rests on the top of cylindrical body 22 for proper vertical positioning of sensor pod 40. Pod body 44 has at least one and most preferably a plurality of sensors 50 attached in receptacles 46 defined in outer surface 45 of pod body 44. Sensors 50 are of a type to generate an electrical signal in response to and proportional to the force of a hit by a swung bat. While other sensors are contemplated, sensors 50 in the preferred embodiment are accelerometers. Receptacles 46 are configured to receive and retain sensors 50 such that sensors 50 are substantially flush with outer surface 45. Receptacles 46 and sensors 50 are preferably linearly arranged in a regularly spaced and vertically aligned manner along a line substantially parallel to axis 28. In a most preferred configuration, one of sensors 50 is positioned to be on a radial extending from axis 28 to target 24.

A mount assembly 30 is affixed to a rear portion of cylindrical body 22 at a circumferential position being 180 degrees opposite from target 24. Mount assembly 30 includes mount 32, which is preferably fabricated of a molded resin and is affixed to cylindrical body 22 and sensor pod 40 with bolts 38 and nuts 39. Nuts 39 can be wing nuts to permit the easy replacement of cylindrical body 22. A strap 34 is also affixed to mount 32 and includes a buckle for adjustably securing training aid 20 to an external support. Mount 32 also defines a vertically oriented elongate recess 33 for receiving a portion of an external support therein for maintaining the batting aid 20 in alignment with the external support.

One or more electronic displays 60 are affixed to mount 32. Electronic displays 60 can be hard-wired to sensors 50 for communication of the output of sensors 50. Alternatively, the output of sensors 50 can be communicated wirelessly between sensors 50 and displays 60. When a bat strikes cylindrical body 22, each sensor 50 is subjected to a unique force that is at least partially a function of its relative position to the strike point. Display 60 integrates the various outputs of sensors 50 and subsequently determines the strike point with respect to target 24 and the force or power of the bat strike. This information is displayed to the user for rapid feedback relating to the form and power of the batter's swing. Multiple displays 60 can be incorporated on mount 32 to facilitate the interchangeable use of the training aid by both left and right-handed batters. Alternately, the obtained data can be wirelessly transmitted to a remote receiving apparatus (not shown), such as a computer.

Figure 6:
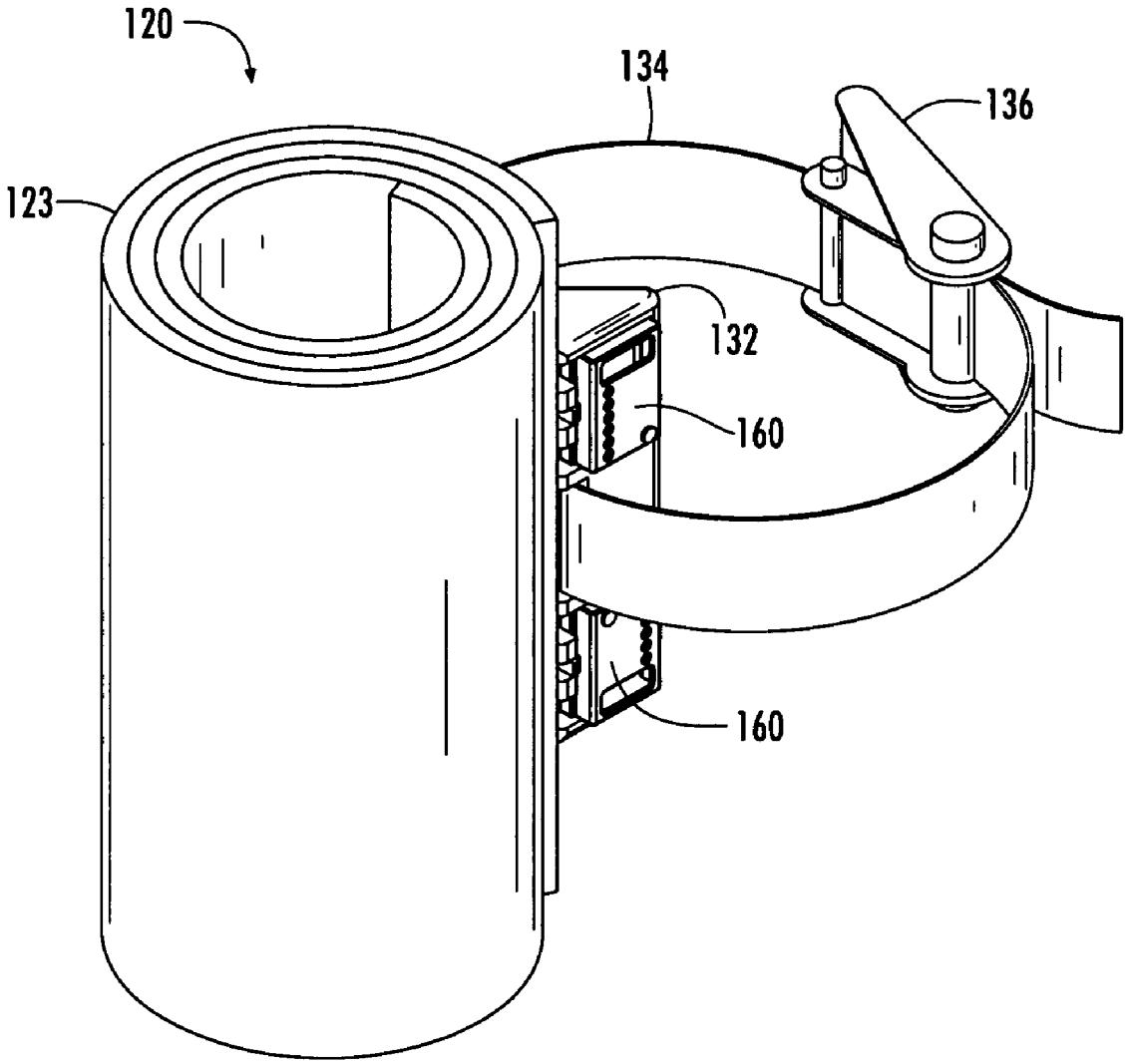
FIG. 6 is an alternate embodiment batting training aid illustrating a rolled resilient member.
Figure 7:
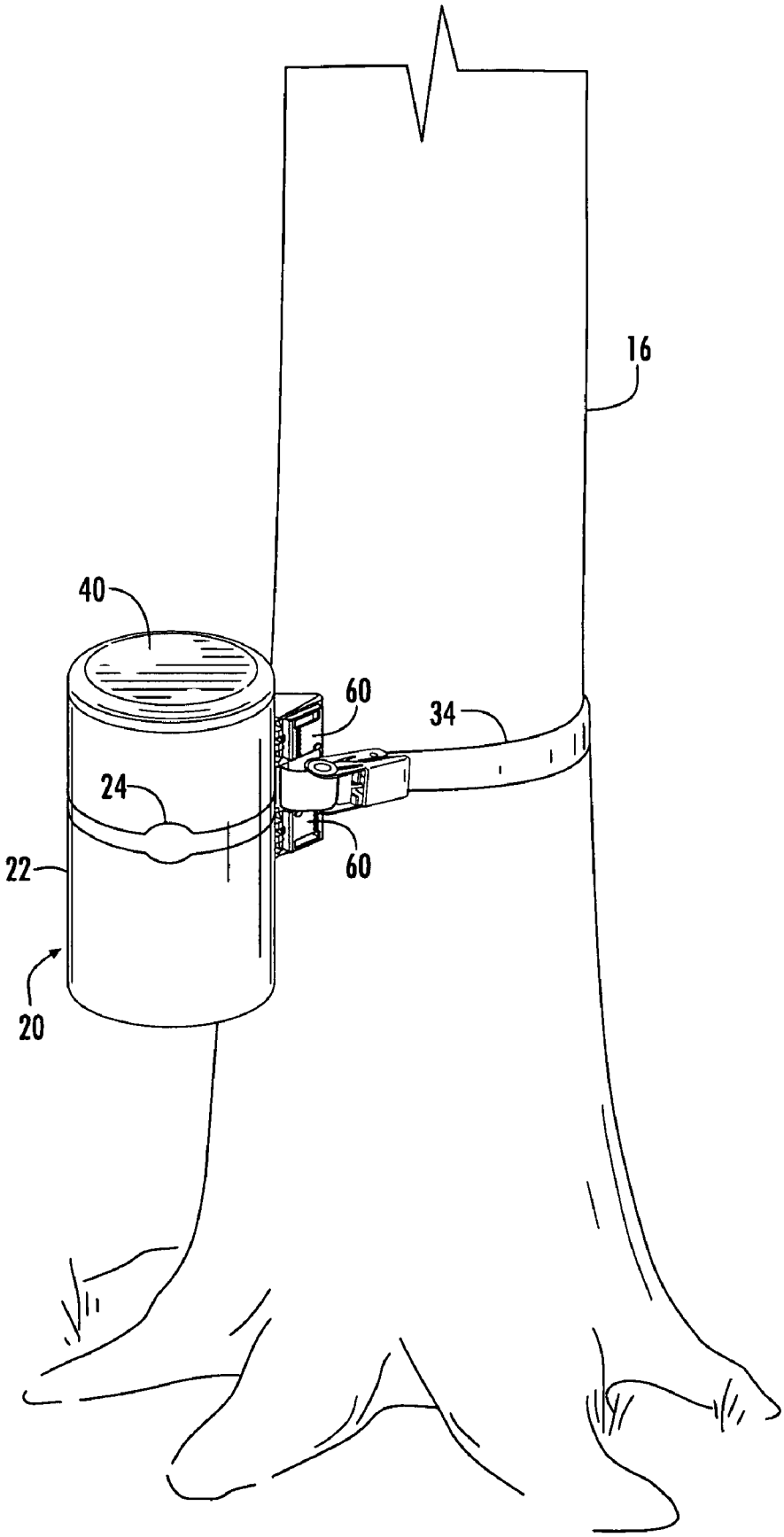
FIG. 7 is a perspective view of the batting training aid attached to a tree.

FIG. 6 illustrates an alternate embodiment batting aid 120 wherein cylindrical body 123 is formed by rolling a flat resilient foam pad or rubber sheet into cylindrical form and then affixing mount 132 and adjustable strap 134 thereto with bolts and nuts (not shown) in a manner similar to that described with respect to training aid 20.

Figure 8:
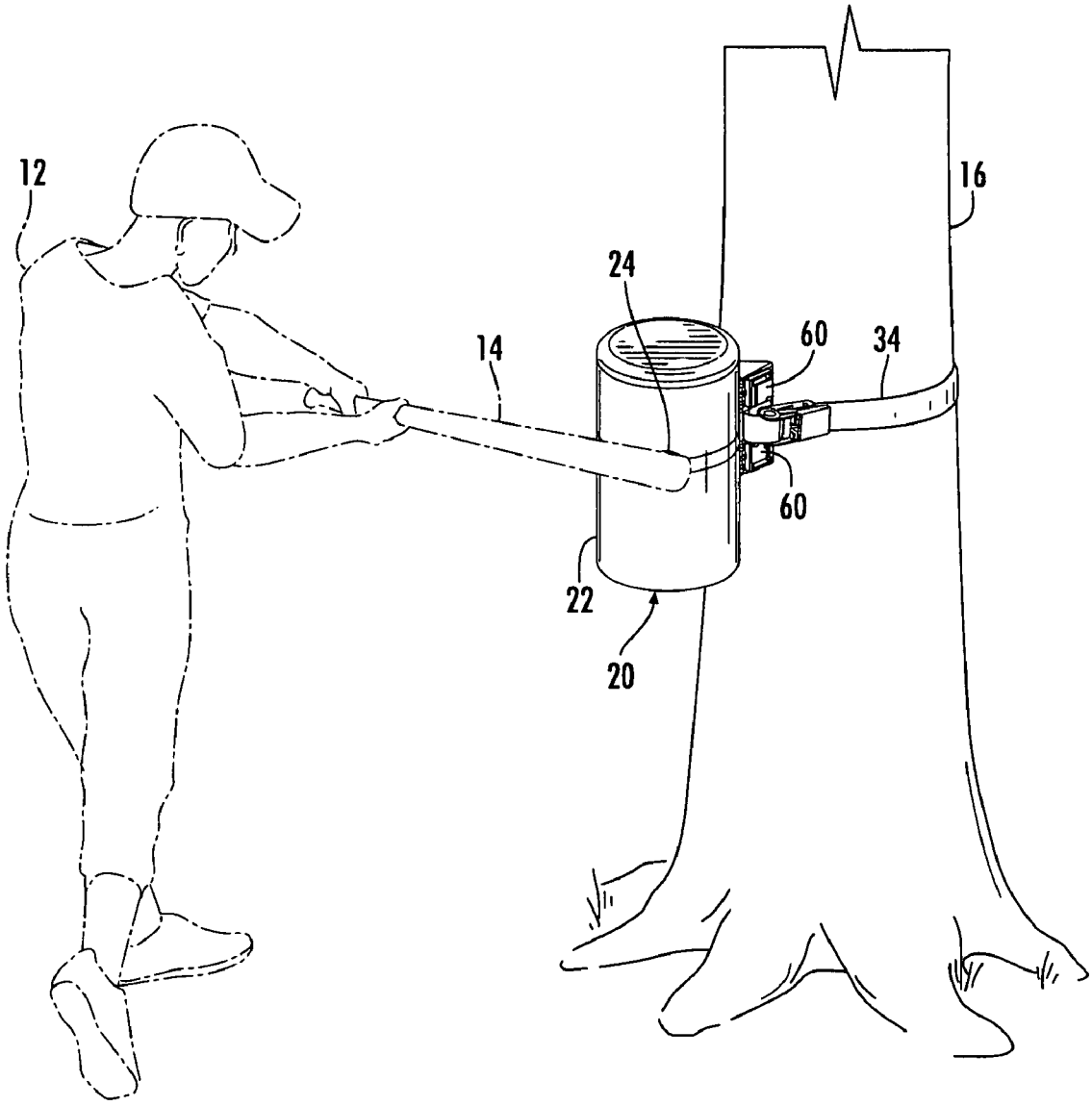
FIG. 8 is a perspective view of the batting training aid in use by a batting trainee.
Figure 9:
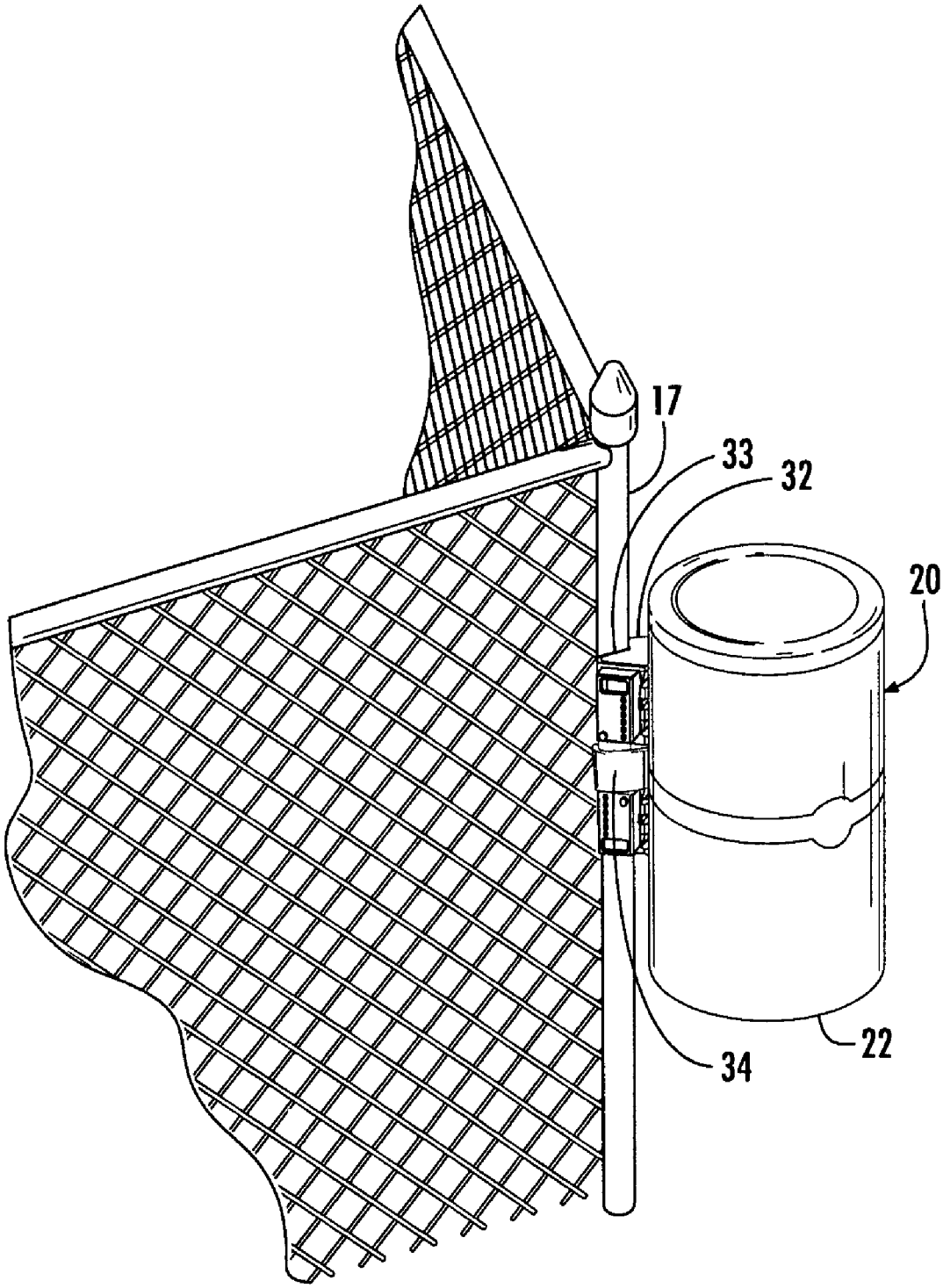
FIG. 9 is a perspective view of the batting training aid attached to a fence post.
Figure 10:
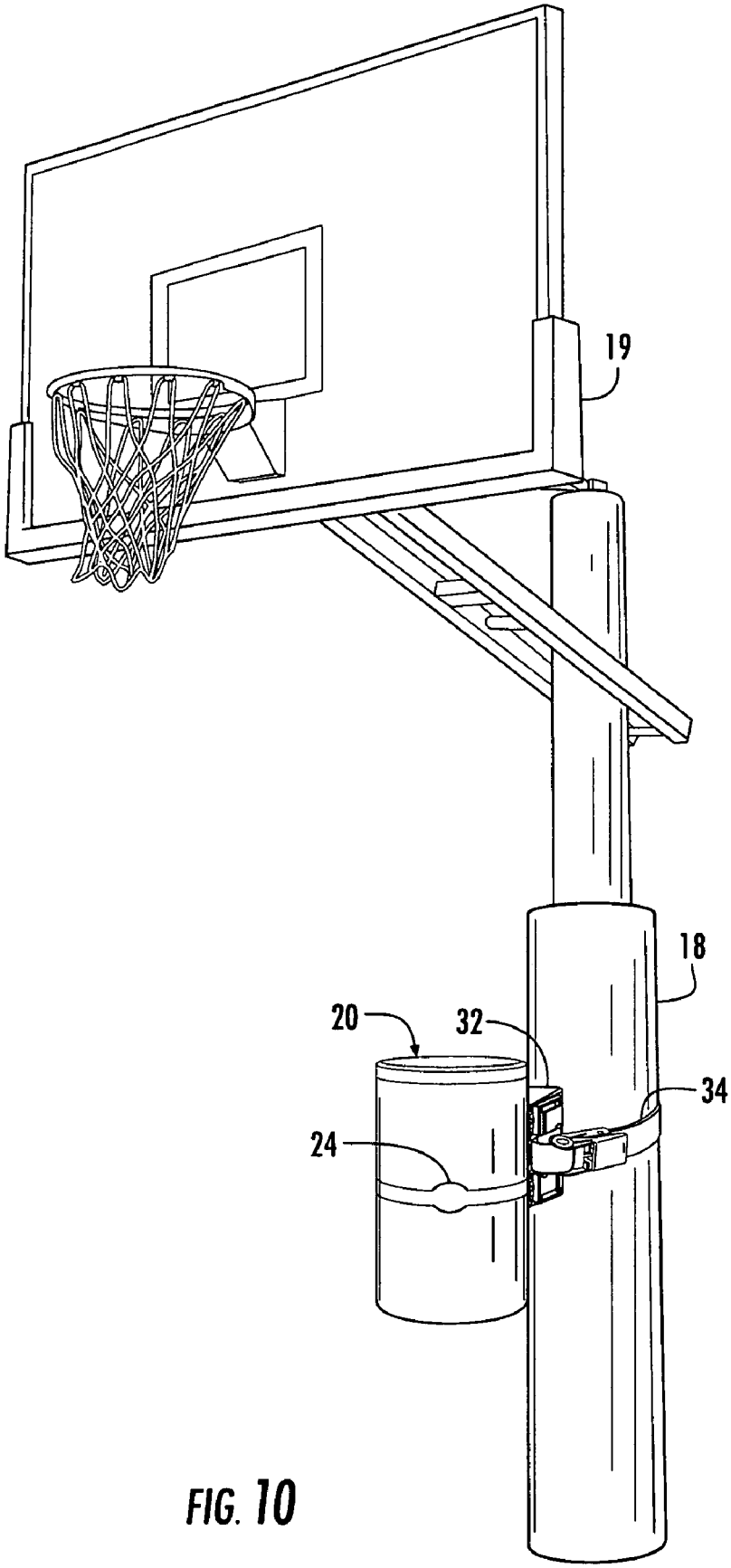
FIG. 10 is a perspective view of the batting training aid attached to the support post of a basketball backboard.

In use, and now referring to FIGS. 7-10, the batting training aid 20 is placed against a substantially vertical support such as a tree 16 (FIGS. 7-8), a fence post 17 (FIG. 9), or a support post 18 for a basketball backboard 19. These figures are exemplary and those practiced in the art will understand that batting aid 20 can also be readily attached to other supports in like manner. The support 16, 17, 18 is partially received in recess 33 of mount 32 to substantially align batting aid 20 with a longitudinal axis of the support 16, 17, 18. Strap 34 and buckle 36 are adjusted to secure batting aid 20 to the support 16, 17, 18 such that target 24 is at a desired height above the ground corresponding to the user's height. Referring to FIG. 8, once batting aid 20 has been secured to support 16, 17, 18, batter 12 grasps bat 14 and assumes a desired stance as though the batter 12 was going to swing at a pitched ball. Substituting target 24 for a ball to be hit, batter 12 swings the bat 14 to hit the target 24. When the batting aid 20 has been struck with bat 14, the batter 12 can look at display 60 to determine the location of the bat strike with respect to target 24 and to determine the power delivered to batting aid 20 with the bat strike. This process can be repeated by the batter 12 while making minor adjustments in stance, arm placement, swing speed, etc. to obtain an optimal power swing.

With a wireless interface between the batting aid 20 and a remote data collection interface, a training coach can remotely monitor the data and provide feedback to the batter 12. Data such as contact power, contact location, repetition of swings, and the like can be analyzed by software provided in the remote monitor.

It is recognized a less complex version of the batting aid 20 can be provided, including a resilient tubular structure and a respective mounting assembly. The tubular structure 40 can be fabricated via a molding process, an extruding process, a rolling process (FIG. 6) and the like. The strap 34 can be affixed to the tubular structure 40 via any reasonable assembly interface.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

We claim:

1. A training aid for impact sports comprising:

a vertically oriented resilient tubular body, said tubular body defining a central core, said central core sized to receive a sensor pod;

a mount assembly affixed to an outer surface of said tubular body for affixing said training aid to an external support;

a sensor pod having a pod body sized and shaped to be closely received within said central core of said tubular body, said sensor pod having a cap at a top portion of said sensor pod extending radially outward from said pod body, said cap resting on an upper surface of said tubular body for positioning of said sensor pod, said pod body including at least one receptacle configured to receive and retain at least one accelerometer; and at least one accelerometer mounted on said sensor pod for sensing a strike against said resilient tubular body; and an electronic display electrically coupled to said at least one accelerometer, said electronic display constructed and arranged to display an indication of the striking power of a strike upon said resilient tubular body sensed by said at least one accelerometer.

2. The training aid according to claim 1 wherein said resilient tubular body is fabricated of cylindrically formed, resilient foam.

3. The training aid according to claim 1 wherein said resilient tubular body is a flat sheet of foamed polymeric material rolled into a tubular shape.

4. The training aid according to claim 1 wherein said resilient tubular body includes a visible target positioned substantially at about a vertical midpoint of said resilient tubular body.

5. The training aid according to claim 4 wherein said at least one accelerometer is positioned substantially in radial registration with said visible target.

6. The training aid according to claim 5 further including said electronic display communicatively coupled to said at least one accelerometer, said electronic display configured to display an indication of the striking power of a bat strike upon said resilient tubular body sensed by said accelerometer.

7. The training aid according to claim 6 wherein said at least one accelerometer and said electronic display communicate in a wireless fashion.

8. The training aid according to claim 4 wherein said sensor pod includes a plurality of sensors attached thereto.

9. The training aid according to claim 8 wherein said plurality of sensors are arranged in a regularly spaced manner on said sensor pod along a line parallel with a central axis of said resilient tubular body and are circumferentially aligned with said visible target.

10. The training aid according to claim 9 wherein one of said plurality of sensors is positioned substantially in radial registration with said visible target.

11. The training aid according to claim 10 wherein said electronic display is communicatively coupled to said plurality of sensors, said electronic display configured to integrate outputs of said plurality of sensors and display an indication of the striking power of a bat strike upon said resilient tubular body.

12. The training aid according to claim 11 further including a second display, said second display oppositely oriented from said first display to facilitate said training aid to be interchangeably used by right handed trainees and left handed trainees.

13. The training aid according to claim 1 wherein said mount assembly includes a vertically oriented elongate recess for receiving a portion of a vertical external support therein and to maintain said training aid in a vertical orientation.

14. The training aid according to claim 13 wherein said mount assembly further includes an adjustable strap for securing said training aid to a vertical support.

15. A strength training aid comprising:

a vertically oriented resilient tubular body, said body defining a central core;

a mount affixed to a rear of said resilient tubular body for affixing said training aid to a vertical external support, said mount defining a vertically oriented elongate recess for receiving a portion of the vertical external support therein and to maintain said training aid in a vertical orientation;

a sensor pod received within said central core of said resilient body, said sensor pod having a pod body sized and shaped to be closely received within said central core of said resilient tubular body, said sensor pod having a cap at a top portion of said sensor pod extending radially outward from said pod body, said cap resting on an upper surface of said tubular body for positioning of said sensor pod, said pod body including at least one receptacle configured to receive and retain a plurality of accelerometers;

a plurality of accelerometers mounted on said sensor pod for sensing a strike against said resilient tubular body; and an electronic display communicatively coupled to said plurality of accelerometers, said electronic display configured to integrate outputs of said plurality of accelerometers and display an indication of the striking power of a bat strike upon said resilient tubular body.

16. The strength training aid according to claim 15 wherein said resilient tubular body includes a visible target positioned substantially at a vertical midpoint of said resilient tubular body.

17. The strength training aid according to claim 16 wherein said plurality of accelerometers are arranged in a regularly spaced manner on said sensor pod along a line parallel with a central axis of said resilient body.

18. The strength training aid according to claim 17 wherein one of said plurality of accelerometers is positioned substantially in radial registration with said visible target.

19. The strength training aid according to claim 18 further including a second display, said second display oppositely oriented from said first display to facilitate said training aid to be interchangeably used by right handed batters and left handed batters.

* * * * *